United States Patent [19]

Franke, Sr., John

[11] Patent Number: 4,613,123

[45] Date of Patent: Sep. 23, 1986

[54] MATERIAL HANDLING DEVICE

[75] Inventor: Franke, Sr., John, Glendale, Calif.

[73] Assignees: The Singer Company, Stamford, Conn.; AVG Productions, Inc., Valencia, Calif.

[21] Appl. No.: 611,692

[22] Filed: May 18, 1984

[51] Int. Cl.[4] ..... B65H 3/22

[52] U.S. Cl. ..... 271/18.3

[58] Field of Search ..... 271/18.3

[56] References Cited

U.S. PATENT DOCUMENTS

| | | | |
|---|---|---|---|
| 3,386,763 | 6/1968 | Ottaway | 271/18.3 X |
| 3,981,495 | 9/1976 | Bijttebier | 271/18.3 |
| 4,008,888 | 2/1977 | Vinciguerra | 271/18.3 |
| 4,042,271 | 8/1977 | Vinciguerra | 271/18.3 X |
| 4,372,548 | 2/1983 | Aurich | 271/18.3 |
| 4,482,143 | 11/1984 | Torre | 271/18.3 |

*Primary Examiner*—Richard A. Schacher

*Attorney, Agent, or Firm*—Robert E. Smith; David L. Davis; Edward L. Bell

[57] ABSTRACT

An end effector for use with automatic machines for handing flexible materials including a flat base plate having openings therein, at least two barbs, holders positioning each of said barbs adjacent one of said openings, an arrangement for moving each of said barbs through the adjacent one of the openings along a path which forms an angle of less than forty five degrees with the face of the plate, the arrangement for moving each of the barbs through the adjacent one of the openings limiting the travel of the barb along the path and being adapted to move each of the barbs in a direction generally opposite to the directions of the path.

5 Claims, 7 Drawing Figures

FIG. 2
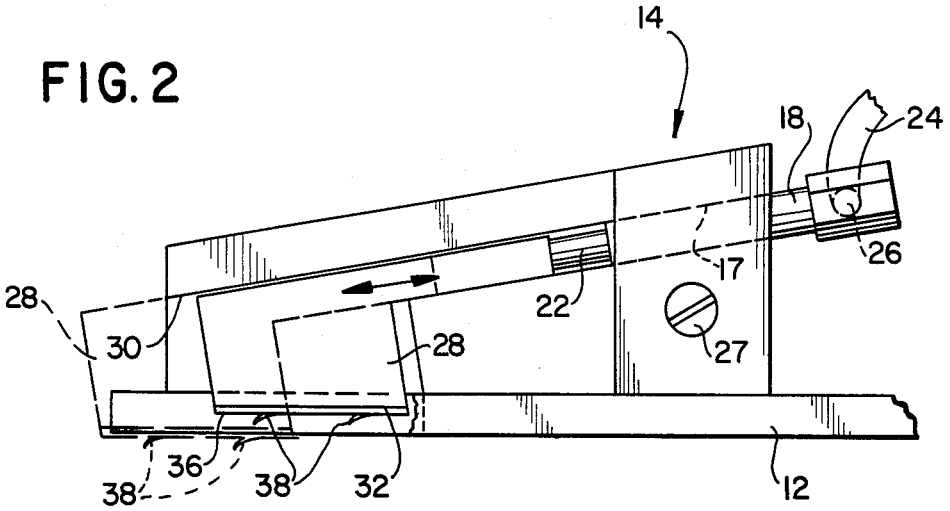
FIG. 3
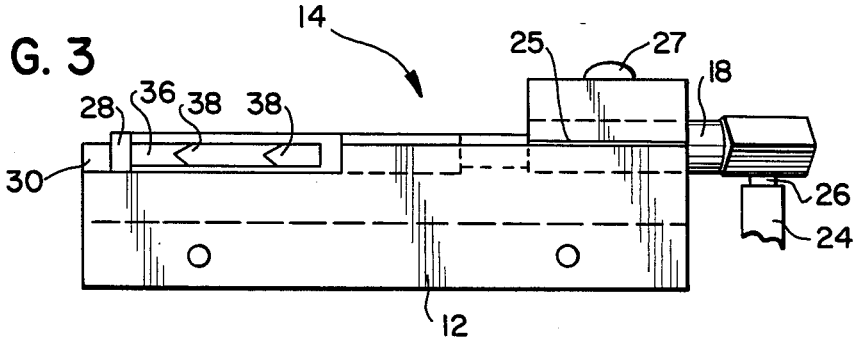
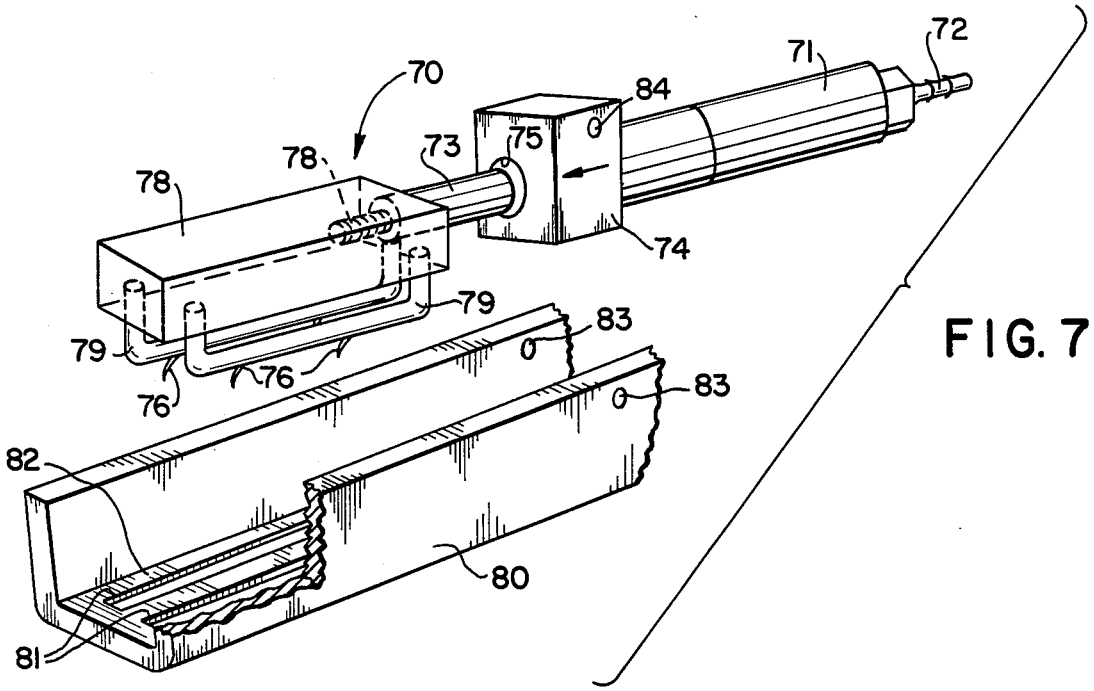
FIG. 7

MATERIAL HANDLING DEVICE

BACKGROUND OF THE INVENTION

This invention relates to automatic machinery and more particularly to automatic machinery for handling cloth and similar flexible materials.

There have been many attempts to devise methods by which flexible materials may be handled automatically. In general, it has proven relatively easy to handle a material such as cloth while it remains in its uncut form. However, once material has been cut into small or any sort of irregular shape, its light weight, flexibility, stretchability, surface texture, and other characteristics make it very difficult to handle in a useful manner. Because of its high labor intensity and the high cost of that labor, the sewing industry is especially ready for such automatic machinery. There are special purpose machines on the market each of which is adapted to accomplish one specific sewing operations over and over. Such machines are very expensive and suited to only the limited special purposes for which they were designed.

To broaden the range of operations, attempts are being made to build robots which may be programmed to perform the many operations of a human operator of a sewing machine. One of the main difficulties has been in providing a device with extreme sensitivity of touch and many degrees of freedom which is capable of simulating the human hand. To date there has been no hand simulator (called an "end effector") found practical to replace the human operator's hands in the automatic sewing of the many types and qualities of materials which must be handled.

There have been devices which use needles adapted to project through a base into some portion of a layer of material in order to handle that material, e.g., see *Canadian Apparel Manufacturer,* pp. 11-18, June 1983, by Frank W. Paul. Theoretically, such a device will work but in actuality there are no industrial sewing machines using such devices because they cannot be made to work reliably. For example, needles have such a shape that they penetrate to essentially an unlimited depth in most materials. Consequently, the depth of penetration must be adjusted so that a particular needle penetrates only a selected thickness of the particular material with which it is to be used. If the adjustment is slightly off, then the needle penetrates either too deeply or too shallowly. If the needle penetrates too deeply, it may break or bend on the surface against which the material is urged; and the device ceases to operate. Alternatively, if the needle penetrates too shallowly, it is not able to secure the material and the device does not operate. (See statistics from above noted article.)

Moreover, needles must be adjusted for each particular thickness of material. For example, if it is desired to pick up a single layer of material and the needles of the end effector project too far, they pass through the piece of material and pick up more than the desired single layer. Thus, while the theory of using needles to handle flexible material such as cloth is quite good, the result is that such devices are unreliable; and the use of labor has been found to be cheaper.

It is, therefore, an object of this invention to provide an end effector which may be used with industrial robots for handling flexible materials.

It is another object of this invention to provide a device which will handle all types of flexible materials.

It is another object of this invention to provide a device which will handle materials in many different opeations.

It is an additional object of this invention to provide a device which will handle varying thicknesses of materials.

It is yet another object of this invention to provide a device which is capable of handling flexible material such as cloth inexpensively and rapidly.

SUMMARY OF THE INVENTION

The foregoing and other objects of this invention are provided in a device which utilizes barbs as pickup devices. The barbs project from shanks which are mounted to arms connected to piston shafts which force them to protrude from a baseplate and project into the material to be handled. By using sets of barbs mounted so that they may be made to project in opposite directions into a piece of flexible material, opposing forces may be placed at separated positions in a piece of material so that the material can be picked up, moved from place to place, rotated, inverted, and otherwise handled as though by a human hand. Since a barb is a sharply angled pointed projection from a shank, both the angle of the point of the barb and the distance to the shank itself limit the amount by which the barb may project into a particular piece of material. Because of this limiting feature, one size of barb may handle many varieties and thicknesses of materials without significant adjustment.

The invention will be better understood by reference to the detailed specification and the drawings in which like reference numerals designate like elements throughout the several views.

BRIEF DESCRIPTION OF THE DRAWINGS

FIG. 2 is an enlarged front view of a fragment of FIG. 1;

FIG. 3 is a bottom view of the enlarged portion shown in FIG. 2;

FIG. 7 is an exploded perspective view, partially cutaway, of another embodiment of the invention.

DESCRIPTION OF THE PREFERRED EMBODIMENT

Figure 1:
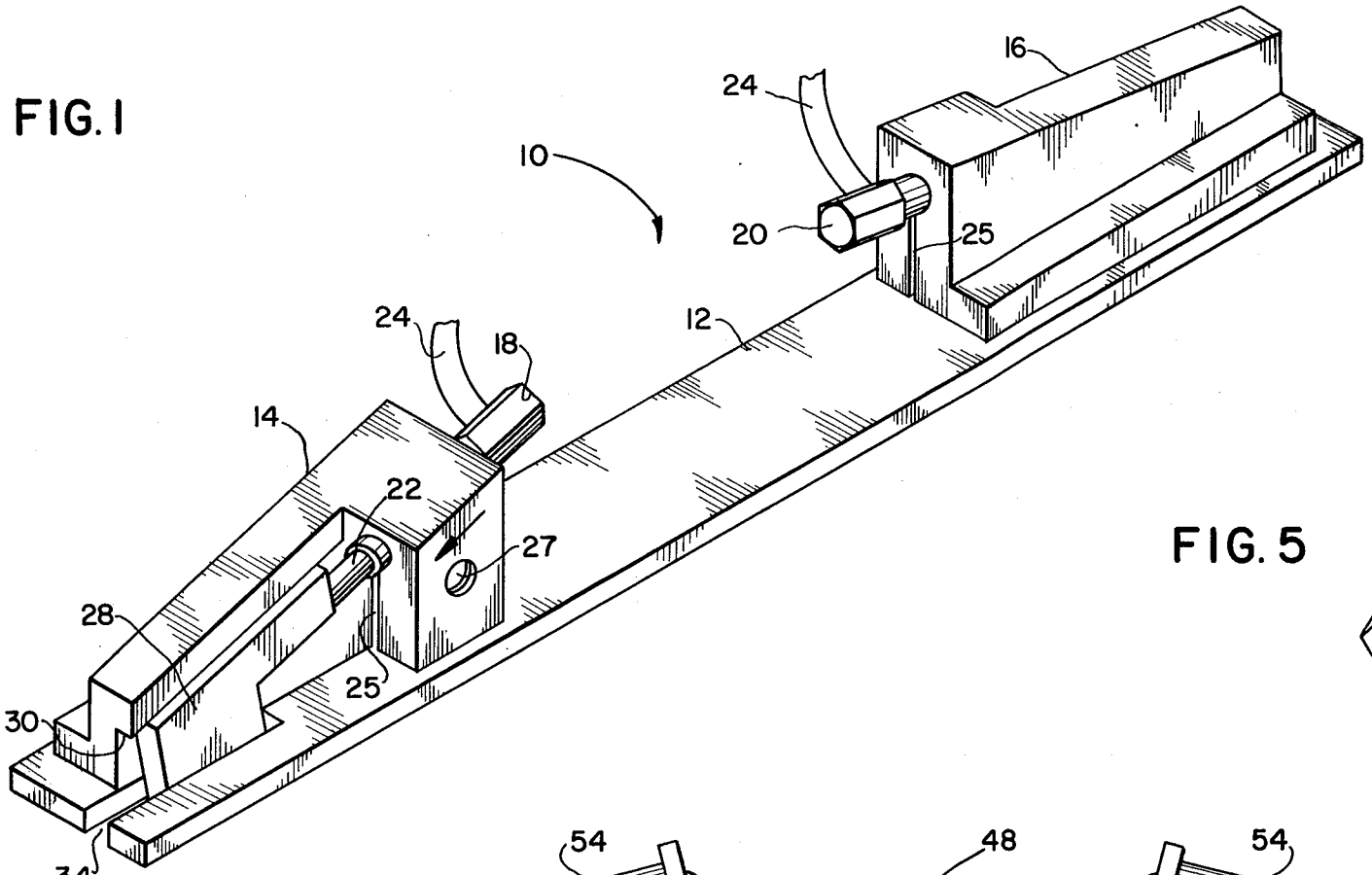
FIG. 1 is a perspective view of a device constructed in accordance with the present invention utilized for handling materials.

Referring now to FIG. 1, there is shown a material handling device 10 constructed in accordance with the invention. The device 10 has a baseplate 12 which may be constructed of a material such as aluminum plate. The plate 12 should be sufficiently thick and of such an alloy that it does not bend in heavy usage. The plate 12 has mounted thereon (such as by screws, not shown in FIG. 1) a first and a second holder 14 and 16, respectively. The holders 14 and 16 may be constructed of a material such as a plastic which may be provided with a slick surface.

Each holder has a passage 17 therein (see FIG. 2) in which is mounted a pneumatic cylinder 18 or 20, respectively. In the embodiment shown, the passages 17 are cylindrical holes adapted to fit closely about the outsides of the cylinders 18 and 20. Each particular cylinder 18 or 20 provides the impetus for actuating the device 10. Each of the pneumatic cylinders 18 and 20 has a shaft 22 mounted to a piston carried in a chamber in the interior thereof in a manner well known to the prior art. These shafts 22 (only one of which, is shown in FIG. 1) are driven outward from the cylinders 18 and 20 along the axis of each of the cylinders when air or other gas is provided by means such as by an airline 24 through an inlet 26 connected to the interior chamber of the particular cylinder 18 or 20. Thus, the provision of air at a selected pressure through the airline 24 causes the shaft 22 to move in the direction of the arrow shown on the near face of the holder 14 in FIG. 1. Although the inventor's assignee manufactures its own pneumatic cylinders which are not sold, pneumatic cylinders of the same type are manufactured by Clippard Instrument Laboratory, Inc., 7390 Colerain Road, Cincinnati, Ohio. A Clippard SM-2 cylinder may be used in the present invention. Such cylinders are normally constructed of aluminum alloy and are quite light in weight.

Cylinders operated by other means, such as solenoids and other mechanical means, might be used to obtain the same movement of a shaft which is used, as will be explained hereinafter to drive barbs into flexible material. However, the aluminum pneumatic cylinders used in the preferred embodiment tend to lighten the device, especially when used in conjunction with a pneumatic actuating arrangement, and make it much more rapid in use.

In the embodiment shown in FIG. 1, a thin opening or slot 25 is provided in each particular holder 14 and 16 so that the cylinders 18 and 20 may be clamped in place as by a screw 27. The slot 25 and the screw 27 allow the cylinders 18 and 20 to be moved axially so that the position to which each shaft 22 extends may be conveniently adjusted and the cylinders 18 and 20 may be readily removed from the holders 14 and 16. The shaft 22 is affixed to an arm 28 which is mounted to slide in a groove 30 in the holder 14. The arm 28 is fashioned from a flat plate in the embodiment of FIG. 1 and may be of metal construction. The arm 28 is polished so that it slides easily. The groove 30 is fashioned to have a shape (generally rectangular in the embodiment shown in the Figures) to fit closely around the arm 28 on all but one side so that the arm 28 may slide freely therein with the movement of the shaft 22. The open side of the groove 30 allows easy removal of the arm 28 when it is desired to change barbs as is explained below. The groove 30 is also polished internally in the preferred embodiment; thus the movement of the shaft 22 causes the arm 28 to move in the direction of the arrow shown on the face of the holder 14.

FIG. 2 is a side view of the holder 14 mounting an arm 28 therein and having a cylinder 18 adapted to move the arm 28 in the direction shown by the arrows thereon. The arm 28 has a lower portion which projects downwardly at approximately a right angle to its main body; this lower portion has a bottom surface 32. As may be seen in FIG. 2, the shaft 22 projecting from the cylinder 18 and the arm 28 are inclined at approximately ten degrees to the lower surface of the plate 12. Thus, as the arm 28 moves outwardly from the cylinder 18, the bottom surface 32 thereof is directed downwardly through an opening 34 (see FIG. 1) in the plate 12. Mounted to the bottom surface 32 of the arm 28 is a shank 36 having a pair of barbs 38 projecting therefrom.

In operation, the plate 12 is placed on top of a piece of material, such as a piece of cloth, by a device such as a computer-actuated robot capable of moving the plate 12 in three dimensions; many such devices are known to the prior art. Air or some other gas is applied through the air lines 24 to the two cylinders 18 and 20, forcing the shafts 22 outwardly and causing the arms 28 to move in the grooves 30 carrying the barbs 38 down at an angle through the openings 34 to the dotted position shown in FIG. 2 against the material. This causes the barbs 38 to pierce the material and stretch it outwardly along the axis of the plate 12. The length of the movement of the shafts 22 is adjusted so that the material is held firmly in place and may be lifted, moved, held in a new place, sewn, and otherwise handled as though by a human hand.

Each of the cylinders 18 and 20 may be conveniently provided with a return spring so that when air pressure is removed from the airlines 24 feeding the cylinders 18 and 20, the shafts 22 retract, drawing with them the arms 28 and causing the barbs 38 to release the material previously secured thereby. In this manner the material may be deposited as desired after any use.

FIG. 3 is a bottom view of the holder 14 shown in FIG. 2 and illustrates the position of the two barbs 38 fixed to the shank 36 and to the arm 28. The shank 36 may be soldered, welded, crimped into position in a groove in the surface 32 or otherwise fixedly secured on and parallel to the pick-up accommodating surface 32 as shown in FIG. 2. As may be seen from FIG. 3, the two barbs 38 are each quite broad at the base (as broad as the shaft in the example shown) and come to a sharp point at the tip. The large angle of the point of such a barb causes its insertion into a particular material to be self limiting in the sense that it may enter a piece of material only until the width of the barb is too large to fit between the interstices of the particular material. Furthermore, the shank 36 from which the barbs 38 protrude provides an ultimate limitation to entry of the barbs 38 into a material. Consequently, the barbs 38 may enter a material used with the device 10 only to the depth provided by the dimensions of the barbs and the interstices of the material itself, a depth ultimately limited by the dimension from the point of each barb 38 to the shank 36. Because of this limiting effect, the device 10 need not be closely adjusted for each type of material with which it is used.

Moreover, because the barbs need not be closely adjusted, they do not work their way out of adjustment easily during use, in contrast to prior art devices utilizing needles driven at an angle into material such as are disclosed by the above-mentioned article. As may be understood, when a needle is directed into a piece of material, its narrow dimension allows it to progress through most materials without halt. Consequently, the length of movement of a needle must be carefully adjusted or it will travel too far into a material, piercing a number of layers and thereby mishandling the material. Alternatively, if a needle is maladjusted so that it protrudes insufficiently into material, the material may easily drop off and again be mishandled. An especially undesirable feature of a needle is its tendency to scratch surfaces lying underneath the material upon which work is to be accomplished or its tendency to bend rendering the entire device inoperative. The self limiting feature of the barbs used in this invention is consequently quite desirable in a material handling situation.

Figure 4:
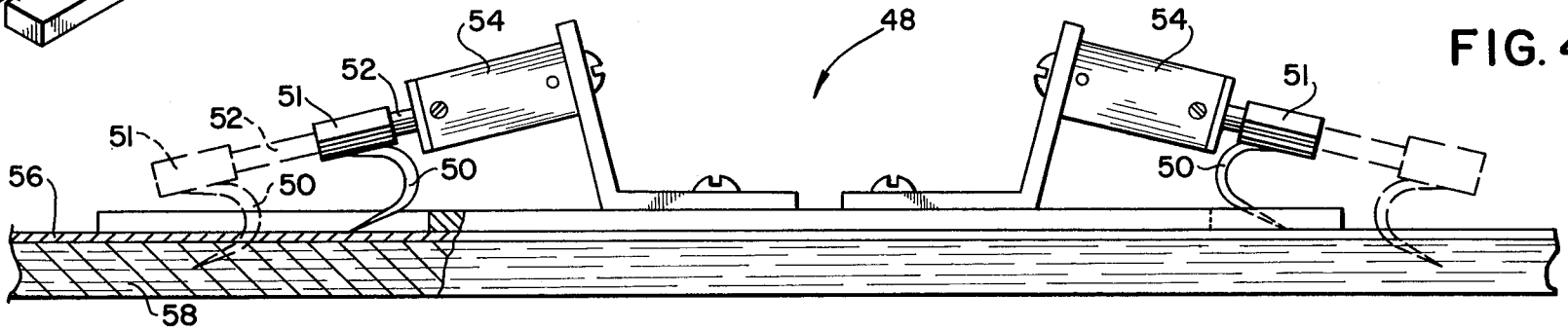
FIG. 4 is a side view of another embodiment of the invention.

FIG. 4 illustrates another embodiment of the invention in which a hook 50 is mounted to the shaft 52 of a pneumatic cylinder 54. The hook 50 is especially useful when a number of materials are to be handled together such as a fabric 56 and a thickness of foam 58. The hook 50 has the self limiting feature of a barb in that the bight of the hook provides a limiting depth to which the hook 50 may be driven. Consequently, when thick materials such as foam layers are used, it is quite useful and is able to handle larger and heavier loads than is a barb.

Figure 5:
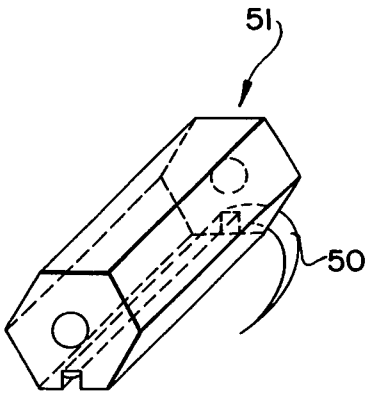
FIG. 5 is an enlarged view of a detail of the arrangement shown in FIG. 4.

FIG. 5 shows a device 51 to which a hook 50 may be attached which may be itself attached to a shaft 52 of a cylinder 54 and used in the arrangement 48 shown in FIG. 4. In a preferred embodiment, the hook 50 has a shape which is a section of a circle generally less than one half of the circle. This provides a fairly large upper surface through which lifting force may be applied to a material, such as a foam material, to allow it to conveniently handle such a material.

Figure 6:
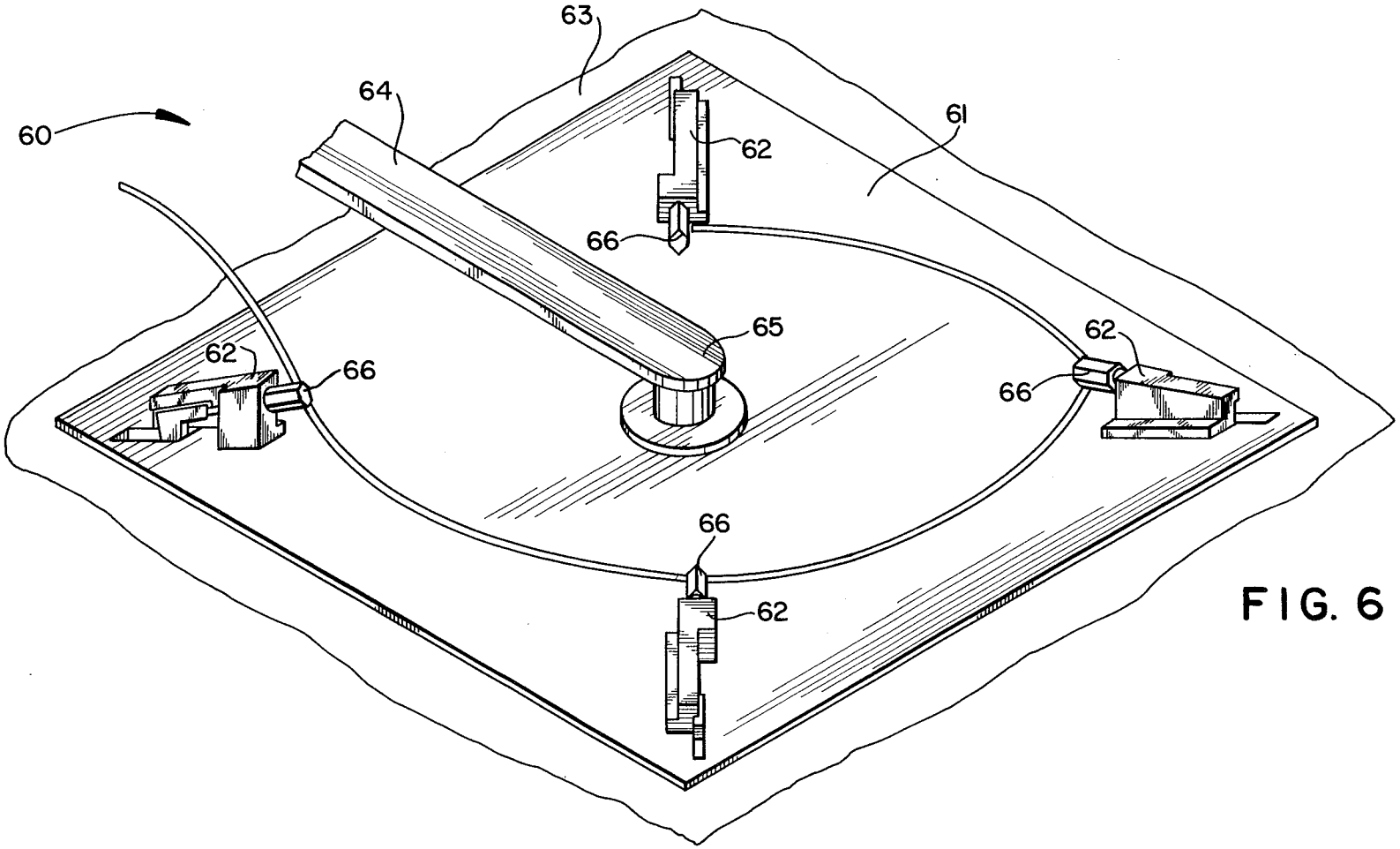
FIG. 6 is a perspective view of a device constructed in accordance with the invention which may be utilized for moving flexible materials from place to place.

FIG. 6 illustrates a device 60 which may be used for picking up and moving about a square piece of material. The device 60 includes a baseplate 61 and four individual holders 62 each of which is provided with a set of barbs such as those shown in the arrangement of FIG. 1. Openings (not shown) are provided below each of the holders 62 in the baseplate 61 so that the barbs may be driven therethrough and into a material 63 positioned therebelow upon which the baseplate 61 lies. An arm 64 is shown connected at a pivot 65 to the baseplate 61 for moving the baseplate from place to place. It will be understood by those skilled in the art that the arm 64 and its attachment to the baseplate 61 are only exemplary and that normally a much more complicated arrangement would be used.

As is shown in FIG. 6, each of the holders 62 is positioned so that the barbs protruding from its base are positioned at 90 degree intervals around the center of the baseplate 61. Consequently, when air is provided to each of a series of cylinders 66 supported within the holders 62, the barbs, not shown in FIG. 6, will be driven into the material 63 postioned below the baseplate 61, stretching it in four directions and flattening it, so that the material may be raised and otherwise moved about to the particular position desired in the particular automatic operation.

FIG. 7 illustrates another end effector 70 which is especially useful in handling very thin pieces of material. The end effector 70 includes a cylinder 71 which receives air or other gas through an inlet 72 and drives a shaft 73 in the direction of the arrow shown on the side of a block 74. The block 74 may be of a plastic material and have a cylindrical hole 75 therethrough through which projects and is secured the front of the cylinder 71. The shaft 73 protrudes from the end of the cylinder 71 and has an end 77 which projects into and supports a block 78. The block 78 may be constructed of material such as a lightweight plastic and secures a pair of shaped rods 79 from which depend barbs 76. Opposite ends of the rods 79 are embedded in the block 78 in the embodiment shown in FIG. 7 but might be secured therein by other means well known to those skilled in the art.

The end effector 70 is made to fit down into a channel 80 having a generally U-shape. The channel 80 may be constructed to accommodate a number of individual end effectors 70, but only one portion thereof is shown. The channel 80 may be constructed of a material such as a thin lightweight aluminum and may have a pair of grooves 81 in the lower surface thereof through which the rods 79 may partially extend so that the barbs 76 project from the lower surface of the channel 80. The dimensions of the end effector 70 are such that the lower surface of the block 74 rides on an upper surface 82 of the base of the channel piece 80; the block 74 is held in place by a pin (not shown in FIG. 7) which may be inserted through holes 83 in the channel 80 and 84 in the block 74 to securely position the block 74 within the channel piece 80. When so positioned, the lower surface of the block 74 will ride on the surface 82 causing the barbs 80 to project through the lower surface of the channel piece 80 at a prescribed distance below that surface.

Such an end effector 70 when used with the channel piece 80 is very useful with extremely thin pieces of material. For example, when the cylinder 71 is operated to drive the shaft 73 outwardly in the direction of the arrow, the barbs 76 which project slightly below the surface of the channel piece 80 are driven in the direction of the arrow and down into any material thereunder. Releasing the gas pressure provided through the inlet 72 allows the barbs 76 to withdraw from the material so that it may be released.

As will be understood by those skilled in the art, various other arrangements than the preferred embodiment may be used for constructing material handling devices such as those shown in this specification without departing from the teachings of the invention. It is, therefore, to be understood that it is the intention of the inventor to be limited only by the scope of the claims appended hereto.

What is claimed is:

1. A device for moving flexible materials, said device including a base member formed with a substantially planar surface adapted to be shifted into and out of engagement with the flexible material to be moved, said base member surface formed with an aperture, a carrier member, a substantially planar pick-up accommodating surface formed on said carrier member, a pick-up element formed with a substantially straight shank and at least one sharp pointed projection extending laterally a predetermined distance from said shank, said pick-up element shank fixedly secured on and parallel to the pick-up accommodating surface of the carrier member with said sharp pointed projection extending outwardly from the pick-up accommodating surface, means shiftably supporting the carrier member relative to the base member to move said at least one pick-up element projection through the base member aperture while maintaining the pick-up element accommodating surface and the pick-up element shank secured thereon substantially parallel to the material engaging surface of the base member.

2. A device for moving flexible material as claimed in claim 1 including a plurality of said carrier members each having a pick-up element formed with a substantially straight shank and at least one sharp pointed projection extending from said shank secured thereto, and means for shifting the carrier members in unison relatively to the base member and relatively to each other to move the sharp pointed projections through the base member aperture.

3. A device for moving flexible material as claimed in claim 1 in which the pick-up element is cylindrical and in which said sharp pointed projection comprises a barb struck out from said shank, and in which the barb at the juncture with the shank is substantially as wide as the shank and tapers outwardly to a sharp point.

4. A device for moving flexible material as set forth in claim 3 in which said at least one barb projects from the cylindrical shank at an acute angle and, in which the means shiftably supporting the carrier member relatively to the base member constrains the carrier member to move in a path extending at an angle with respect to the base member material engaging surface which is no larger than the acute angle at which the barb projects from the shank of the pick-up element.

5. A device for moving flexible material as set forth in claim 1 in which the sharp pointed projection of said pick-up element comprises a hook bent outwardly from said shank.

* * * * *